US007581275B2

(12) United States Patent
Rekart

(10) Patent No.: US 7,581,275 B2
(45) Date of Patent: Sep. 1, 2009

(54) PAINT BRUSH FOR USE IN CORNER APPLICATIONS

(76) Inventor: Phillip Rekart, 5704 W. 89th Pl., Oak Lawn, IL (US) 60453

( * ) Notice: Subject to any disclaimer, the term of this patent is extended or adjusted under 35 U.S.C. 154(b) by 460 days.

(21) Appl. No.: 11/173,428

(22) Filed: Jul. 1, 2005

(65) Prior Publication Data

US 2006/0000042 A1 Jan. 5, 2006

Related U.S. Application Data

(60) Provisional application No. 60/584,979, filed on Jul. 2, 2004.

(51) Int. Cl.
*A46B 3/12* (2006.01)
*A46B 7/04* (2006.01)
*A46B 9/02* (2006.01)

(52) U.S. Cl. ..... 15/160; 15/145; 15/176.6; 15/191.1; 15/202; 15/DIG. 4; D4/135

(58) Field of Classification Search ..... 15/145, 15/146, 159.1, 160, 166, 168, 171, 176.1, 15/176.6, 174, 191.1, 192, 193, 202, DIG. 4; D4/130, 132, 135
See application file for complete search history.

(56) References Cited

U.S. PATENT DOCUMENTS 1,319,493 A * 10/1919 Severance ..... 15/160
2,662,240 A * 12/1953 Perkins ..... 15/246
2,736,051 A * 2/1956 Boodakian ..... 15/160
3,464,079 A 9/1969 Palmer
3,503,089 A 3/1970 Coneway
3,728,755 A 4/1973 Whalen
3,761,990 A 10/1973 Lynn
3,894,807 A * 7/1975 Betz, III ..... 403/221
4,360,940 A 11/1982 Smith
4,364,143 A * 12/1982 Uhl ..... 15/145
4,674,144 A 6/1987 Palmeri
4,791,695 A * 12/1988 Kephart ..... 15/160
5,267,369 A 12/1993 O'Neil et al.
5,293,662 A 3/1994 Newman, Sr. et al.
5,432,972 A 7/1995 Polzin et al.
5,544,384 A 8/1996 Forselius et al.
D387,564 S * 12/1997 Talbot ..... D4/135
D428,706 S 8/2000 Thunderchild
6,510,578 B1 * 1/2003 Cyr et al. ..... 15/176.6
7,086,115 B1 * 8/2006 Rex et al. ..... 15/144.1

FOREIGN PATENT DOCUMENTS

EP 640303 * 8/1994

* cited by examiner

*Primary Examiner*—Mark Spisich
(74) *Attorney, Agent, or Firm*—McDermott Will & Emery, LLP

(57) ABSTRACT

A paint brush for use in corner applications is provided. The paint brush comprises a handle having a first end and second end, a ferrule receiver, and a detachable ferrule. The ferrule receiver is attached to the second end of the handle and includes a locking mechanism for providing securable attachment of a ferrule. The ferrule is disposed in slidable engagement with the ferrule receiver and is configured to an angle of less than 180 degrees. The ferrule includes a plurality of bristles secured therein, and extending axially therefrom.

11 Claims, 2 Drawing Sheets

FIG. 3
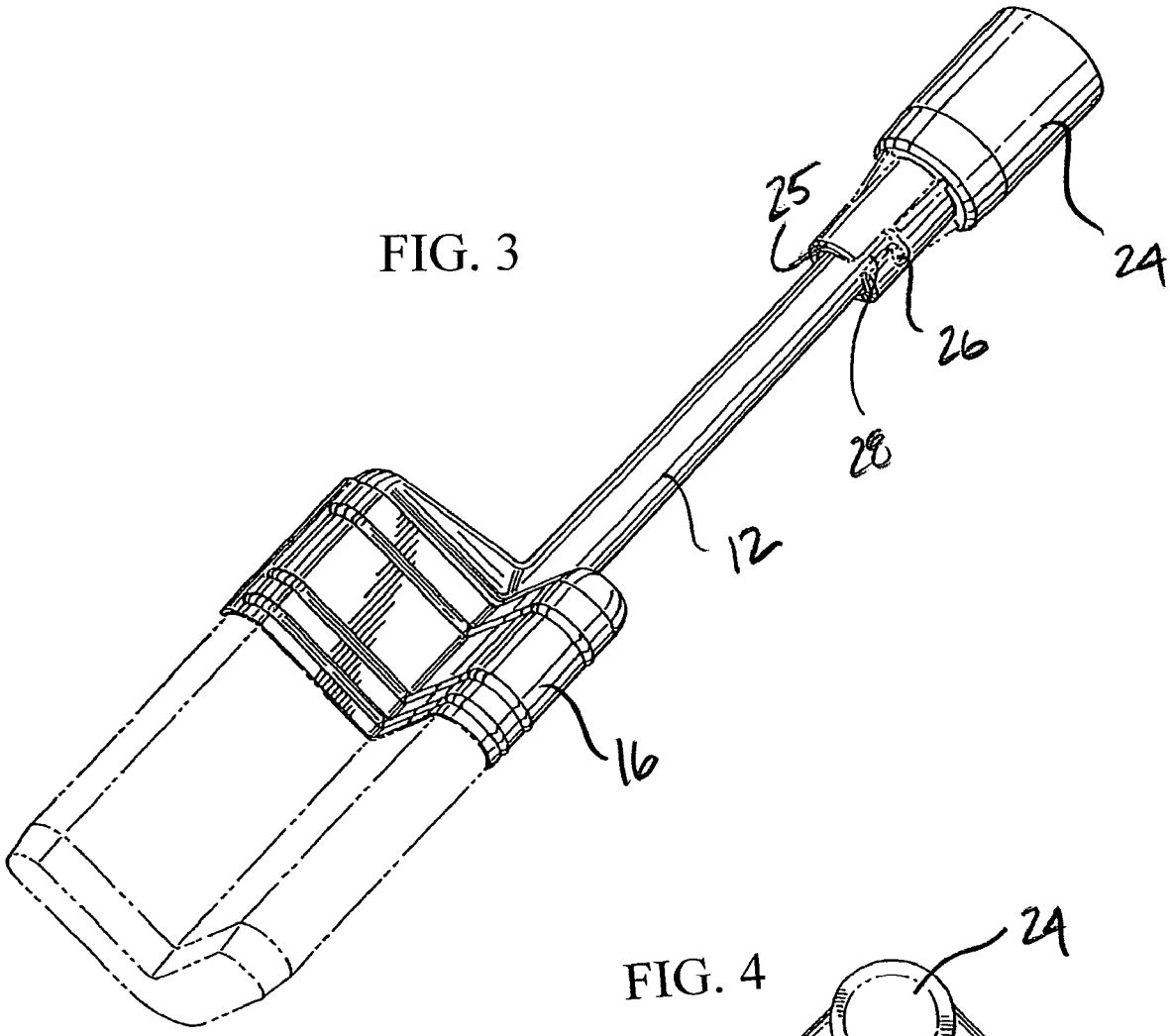
FIG. 4
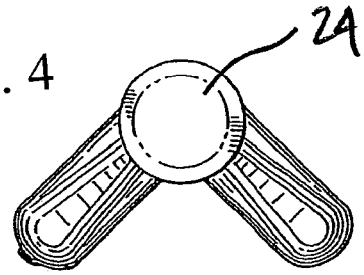
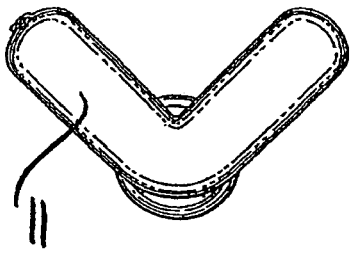
FIG. 5

PAINT BRUSH FOR USE IN CORNER APPLICATIONS

CROSS-REFERENCE TO RELATED APPLICATIONS

This application claims the benefit of U.S. Provisional Application No. 60/584,979, filed Jul. 2, 2004.

TECHNICAL FIELD

The invention relates to a paint brush for use in corner applications, in particular to a paint brush for corner applications with a replaceable ferrule.

BACKGROUND OF THE INVENTION

It is often necessary to paint the corners of a structure such as the wall of a room or the like. In the past painters have manipulated the bristles of traditional paint brushes into corners to accomplish the task. However, use of traditional paint brushes often results in uneven, excessive or undesirable application of paint to the corners. Such use also often results in damage to the bristles of the paint brush. Thus, there is a need to provide a paint brush that facilitates even and aesthetically pleasing application of paint to corners. There is also a need to provide a paint brush in which the bristles may be easily replaced if damaged or worn.

The present invention is provided to solve the problems discussed above and other problems, and to provide advantages and aspects not provided by prior paint brushes. A full discussion of the features and advantages of the present invention is deferred to the following detailed description, which proceeds with reference to the accompanying drawings.

SUMMARY OF THE INVENTION

The present invention provides a paint brush for use in corner applications. The paint brush comprises a handle, a ferrule and bristles. The handle has a first end and a second end. The ferrule is attached to the second end of the handle and is configured to an angle of less than 180 degrees. A plurality of bristles is secured within the ferrule, and extend axially therefrom.

According to another aspect of the present invention, the paint brush comprises a handle having a first end and second end, a ferrule receiver, and a detachable ferrule. The ferrule receiver is attached to the second end of the handle and includes a locking mechanism for providing securable attachment of the ferrule. The ferrule is disposed in slidable engagement with the ferrule receiver, and is configured to an angle of less than 180 degrees. The ferrule includes a plurality of bristles attached therein, and extending axially therefrom.

According to one aspect of the present invention, the ferrule receiver of the above described paint brush includes a locking mechanism disposed thereon. The locking mechanism is comprised of a flexible appendage having a protrusion raised thereon. The ferrule includes an aperture, such that when the detachable ferrule slidably engages the ferrule receiver, and the aperture engages the protrusion of the locking mechanism, thereby securing the ferrule to the detachable ferrule receiver.

According to another aspect of the present invention, the paint brush further includes an adaptor that is removably attached to the first end of the paint brush. The adaptor allows for attachment of an extension handle to the paint brush.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 3 is another perspective view of the paint brush according to the present invention with bristles in broken lines;

FIG. 4 is a end plan view of the handle end paint brush shown in FIG. 3; and, FIG. 5 is a end plan view of the bristle end paint brush shown in FIG. 3 (shown with bristles in broken lines).

DETAILED DESCRIPTION

Figures 1, 2:
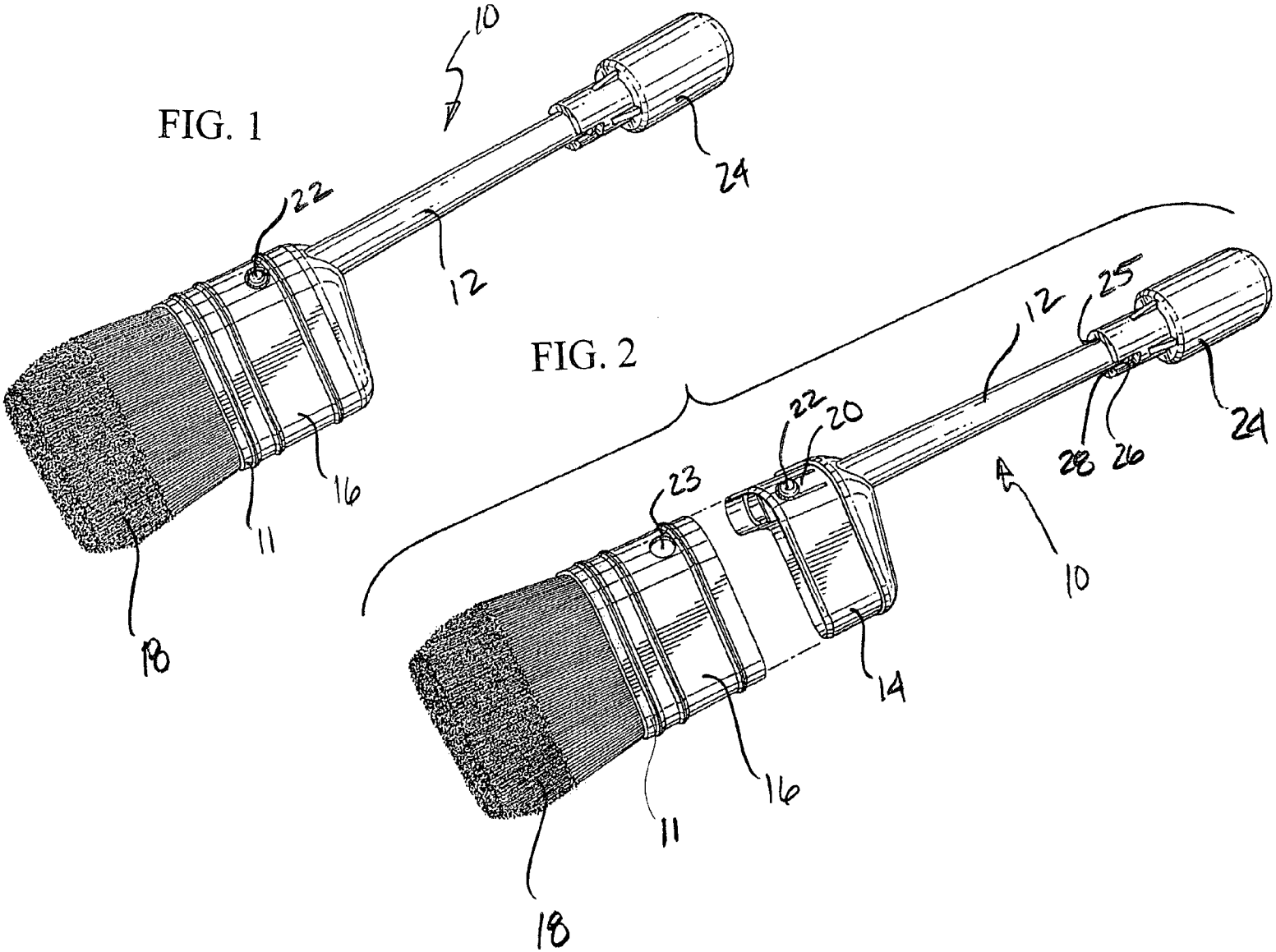
FIG. 1 is a perspective view of a paint brush according to the present invention.
FIG. 2 is an exploded perspective view of the paint brush shown in FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now in detail to the FIGS. 1-5, there is generally shown a paint brush 10 for use in corner applications. The paint brush 10 comprises a handle 12 having a first end and second end, a ferrule receiver 14 attached to the second end of the handle 12, and a detachable ferrule 16. According to the present invention, the handle 12 may be made from wood, metal, plastic or other polymeric material suitable for use with paint brushes.

Also, the paint brush 10 of the present invention preferably will assume the general ornamental shape and design of the paint brush 10 shown in U.S. patent application Nos. 29/199,092 and 29/204,342. However, it is contemplated that the paint brush 10 may assume any suitable shape or design without departing from the spirit of the present invention. For example, the handle 12 of the paint brush may assume alternate configurations or incorporate certain ergonomic elements.

The detachable ferrule 16 of the present invention is comprised of a bristle holder 11 that securably holds a plurality of bristles 18. The bristles 18 of the present invention are configured to extend axially from the bristle holder 11 and in the plane of the paint brush 10. The ferrule 16 of the present invention is attached to the ferrule receiver 14 in a slidably engaging manner. According to the present in invention, the ferrule 16 is configured to an angle of less than 180 degrees, such that the collection of bristles 18 therein conform to the same angle. This angled configuration facilitates painting corners in a room or the like. In one preferred embodiment the ferrule 16 is configured to an angle of 90 degrees.

As discussed above, the ferrule receiver 14 is attached to the second end of the handle 12. It is contemplated that the ferrule 16 and ferrule receiver 14 be sized in such a way that the ferrule may be securably attached to the ferrule receiver 14 by friction fit in a complementary fashion. Alternatively, and as shown in one embodiment of the invention shown in FIGS. 1 and 2, the ferrule receiver 14 includes a locking mechanism for providing securable attachment of the ferrule 16 (with bristles 18) to the ferrule receiver 14, and thus, to the handle 12. The locking mechanism is comprised of a flexible appendage 20 having a protrusion 22 raised thereon. The ferrule 16 employed in connection with this embodiment includes an aperture 23. Accordingly, when the ferrule 16 slidably engages with the ferrule receiver 14 the aperture 23 securably receives the protrusion 22 of the locking mechanism, thereby securing the ferrule 16 to the ferrule receiver 14.

According to one embodiment of the present invention, the paint brush 10 further includes an adaptor 24 that is removably attached to the first end of the paint brush handle 12. The adaptor 24 allows for attachment of an extension handle to the paint brush 10. Preferably, the adaptor 24 is attached to the handle 12 by a peg 26 and groove locking mechanism as shown in FIGS. 1-3. In such case, a peg 26 extends outwardly from the first end of the handle 12 and an L-shaped groove 28 is disposed in a sidewall of the adaptor 24. The L-shaped groove 28 engages the peg 26, allowing the handle 12 to slide relative to an opening 25 in the adaptor 24 to a predetermined position. At that point the adaptor 24 may be rotated so that the adaptor 24 may no longer move in the plane of the handle 12, thereby securably attaching the adaptor 24 to the paint brush handle 12. Alternatively, the adaptor 24 may be attached to the handle 12 by friction fit, threading or any other suitable method of attachment.

While the specific embodiments have been illustrated and described, numerous modifications come to mind without significantly departing from the spirit of the invention, and the scope of protection is only limited by the scope of the accompanying Claims.

What is claimed is:

1. A paint brush for use in corner applications comprising:

a handle having a first end and a second end;

a ferrule attached to the second end of the handle, the ferrule comprising a sleeve having an open end adapted to receive a plurality of bristles and the ferrule having a V-shape having a pair of straight side portions which are configured to an angle of less than 180 degrees; and a plurality of bristles secured within the open end of the ferrule and extending axially therefrom, the bristles having first ends secured within the ferrule and opposite second ends, the plurality of bristles collectively defining a brush portion with generally the same V-shape as the ferrule from the first to the second ends thereof.

2. The paint brush of claim 1, wherein the ferrule is configured to a 90 degree angle.

3. The paint brush of claim 1, wherein the ferrule is detachably connected to the second end of the handle.

4. The paint brush of claim 1, further comprising an adaptor provided for attaching an extension member to the handle, the adaptor being removably attached to the first end of the handle.

5. The paint brush of claim 4, further comprising a peg and groove locking mechanism, the locking mechanism comprising:

a peg extending outwardly from the first end of the handle; and, an L-shaped groove in a sidewall of the adaptor, the L-shaped groove provided for receiving the peg and for securably attaching the adaptor to the paint brush.

6. A paint brush for use in corner applications comprising:

a handle having a first end and a second end;

a ferrule receiver attached to the second end of the handle, the ferrule receiver having a flexible appendage disposed thereon, the flexible appendage having a protrusion raised thereon; and, a detachable ferrule provided for slidable engagement with the ferrule receiver, the detachable ferrule comprising a sleeve having an open end adapted to receive a plurality of bristles and the ferrule having a V-shape having a pair of straight side portions configured to an angle of less than 180 degrees and comprising:

a plurality of bristles secured within the open end of the ferrule and extending axially therefrom, the bristles having first ends secured within the ferrule and opposite second ends, the plurality of bristles collectively defining a brush portion with generally the same V-shape as the ferrule from the first to the second ends thereof, and, an aperture for securably receiving the protrusion.

7. The paint brush of claim 6, wherein the ferrule is configured to a 90 degree angle.

8. The paint brush of claim 6, further comprising an adaptor provided for attachment of an extension member to the handle, the adaptor being removably attached to the first end of the paint brush.

9. The paint brush of claim 8, further comprising a peg and groove locking mechanism, the locking mechanism comprising:

a peg extending outwardly from the first end of the handle; and, an L-shaped groove in a sidewall of the adaptor, the L-shaped groove provided for receiving the peg and for securably attaching the adaptor to the paint brush.

10. A paint brush for use in corner applications comprising:

a handle having a first end an second end;

a ferrule receiver attached to the second end of the handle, the ferrule receiver comprising a locking mechanism for providing securable attachment of a ferrule; and, a detachable ferrule provided for slidable engagement with the ferrule receiver, the detachable ferrule comprising a sleeve having an open end adapted to receiver a plurality of bristles and the ferrule having a V-shape having a pair of straight side portions which are configured to an angle of less than 180 degrees and comprising a plurality of bristles secured within the open end of the ferrule and extending axially therefrom, the bristles having first ends secured within the ferrule and opposite second ends, the plurality of bristles collectively defining a brush portion with generally the same V-shape as the ferrule from the first to the second ends thereof.

11. A paint brush for use in corner applications comprising:

a handle having a first end and a second end;

a ferrule receiver attached to the second end of the handle; and, a detachable ferrule provided for slidable engagement with the ferrule receiver, the ferrule comprising a sleeve having an open end adapted to receiver a plurality of bristles and the ferrule having a V-shape having a pair of straight side portions which are configured to an angle of less than 180 degrees and comprising a plurality of bristles secured with the open end of the ferrule and extending axially therefrom, the bristles having first ends secured within the ferrule and opposite second ends, the plurality of bristles collectively defining a brush portion with generally the same V-shape as the ferrule from the first to the second ends thereof.

* * * * *